United States Patent [19]

Shah et al.

[11] Patent Number: 4,617,230

[45] Date of Patent: Oct. 14, 1986

[54] LATEX CONTAINING ODOR INHIBITOR

[75] Inventors: Pravinchandra K. Shah, Sheffield Lake; George J. Antlfinger, Avon Lake, both of Ohio

[73] Assignee: The B. F. Goodrich Company, Akron, Ohio

[21] Appl. No.: 820,050

[22] Filed: Jan. 21, 1986

Related U.S. Application Data

[63] Continuation-in-part of Ser. No. 702,862, Feb. 20, 1985, abandoned, which is a continuation of Ser. No. 565,689, Dec. 27, 1983, abandoned.

[51] Int. Cl.[4] ..... D04H 1/58

[52] U.S. Cl. ..... 428/288; 427/36; 427/332; 428/274; 428/289; 428/290; 428/905; 428/913; 524/831; 604/359

[58] Field of Search ..... 428/274, 288, 289, 290, 428/905, 113; 524/831; 427/36, 332

[56] References Cited

U.S. PATENT DOCUMENTS

| | | | |
|---|---|---|---|
| 2,987,421 | 6/1961 | Sherwood | 428/274 |
| 3,318,722 | 5/1967 | Ulbman | 427/332 |
| 4,107,120 | 8/1978 | Plamondon et al. | 524/831 |
| 4,166,882 | 9/1979 | Das et al. | 524/831 |
| 4,340,057 | 7/1982 | Bloch et al. | 428/274 |
| 4,455,342 | 6/1984 | Fink et al. | 524/831 |

*Primary Examiner*—James J. Bell

*Attorney, Agent, or Firm*—George A. Kap; Alan A. Csontos

[57] ABSTRACT

A nonwoven fabric repellent to body fluids and having reduced odor on sterilization by irradiation or steam is made by bonding nonwoven fibers with a saturated latex, forming said nonwoven fabric, and sterilizing said fabric, said latex is prepared by polymerizing, in the presence of 0.1 to 2 weight parts of a free radical initiator and a sufficient amount of a nonionic or anionic emulsifier, 65 to 85 weight parts of a soft hydrophobic monomer having Tg of −80° C. to −20° C., 10 to 30 weight parts of a hard hydrophobic acrylate monomer having Tg of +40° C. to +120° C., 0.1 to 5 weight parts of an unsaturated carboxylic acid containing 3 to 6 carbon atoms, and 0.1 to 5 weight parts of N-alkylol acrylamide or methacrylamide containing 1 to 10 carbon atoms, said latex has post-added and admixed therein 0.01 to 5 weight parts of an odor inhibition agent selected from amine-type antioxidants and hindered phenols that function to reduce odor of said fabric on sterilization thereof.

36 Claims, No Drawings

LATEX CONTAINING ODOR INHIBITOR

REFERENCE TO RELATED APPLICATION

This is a continuation-in-part application of application Ser. No. 702,862 filed Feb. 20, 1985 now abandoned, which is a continuation application of application Ser. No. 565,689 filed Dec. 27, 1983, and entitled "Latex Containing Odor Inhibitor", now abandoned.

BACKGROUND OF THE INVENTION

A nonwoven fabric is a textile structure consisting of a mat of fibers held together with a bonding material. The fibers can be partially oriented or they can be completely randomly distributed. Latex is often used as the binder for the fibers in nonwoven fabrics.

Nonwoven fabrics are popular owing to the simplicity and economy of their production since the traditional weaving operations are not used; hence, less equipment, less space, and fewer personnel are required. Nonwoven fabrics can also be produced from what would normally be considered as waste fibers, and useful characteristics are obtained which may not be provided by woven or knitted fabrics.

Enormous quantity of fibers are consumed annually in applications of nonwoven fabrics such as clothing, interliners, filters, automotive door panels, heat and electrical insulation, packaging, sanitary napkins, fillers for quilted structures, wiping cloths, towels, masks, wall coverings, shoe uppers and liners, curtains and draperies, tea bags, simulated leather, gaskets, luggage, ribbons, and diapers.

In the medical/surgical field, nonwoven fabrics are used in surgical drapes, surgical caps and gowns, as wraps for surgical instruments and the like. The surgical use requires that the fabric used be sterilized. In the case of latex-impregnated fabric used for drapes, gowns and caps, such items are wrapped and sealed in polyolefin bags and then are sterilized with gamma ray radiation. At time of use, the bags are opened and the doctors and nurses put on the caps and gowns and use the drapes to cover the patient during surgery. When the bags are opened, they often emit odors. In the case of the wraps, after being washed, surgical instruments are stacked in a tray and then wrapped in the latex-impregnated nonwoven fabric and sterilized in steam. After steam sterilization, the wrapped instrument trays are removed from the sterilization unit. When the door to the sterilization unit is opened to remove the wrapped instrument tray, an odor is emitted from the fabric that can be quite potent.

Therefore, in order to sell nonwoven fabric bonded with a latex, the post-sterilization odor should be minimized.

In the past, antioxidants have been added to unsaturated latexes to prevent degradation of the unsaturated polymer backbone in the presence of air, ozone, heat, and light. Examples of unsaturated latexes include polybutadiene, poly(butadiene-styrene), poly(butadiene-acrylonitrile), polyisoprene, and polychloroprene. Saturated latexes are prepared by homopolymerizing esters of acrylic or methacrylic acids or copolymerizing esters of acrylic or methacrylic acids with other vinyl monomers such as acrylonitrile, styrene, vinyl chloride, and vinyl acetate. The saturated latexes do not need protection of antioxidants and whenever antioxidants were added to saturated latexes, they were added for colloidal stabilization, which is unrelated to the antioxidant function.

Hydrophilic acrylic latexes based on poly(ethyl acrylate) have been available in the past for bonding nonwoven fibers. Such latexes were prepared by polymerizing in excess of 90 weight parts ethyl acrylate; less than 5 parts of each N-methylol acrylamide, acrylamide, or acrylonitrile; a low level of an emulsifier; and less than 1 weight part of an antioxidant selected from hindered and partially hindered phenols, such as a mixture of 2,2'-di-t-butyl Bisphenol A, 2-t-butyl-2'-α-methylbenzyl Bisphenol A, 2,6-di-t-butylphenol, 2-t-butyl-isopropylphenol, etc. The antioxidant was added as an emulsion to provide additional colloidal stability.

The Spaulding U.S. Pat. No. 3,539,434 describes nonwoven, bonded articles which retain a high level of physical properties even after prolonged exposure to aging and treatment with typical dry cleaning solvents. The physical properties of concern to Spaulding are tensile strength and elongation. The noted advantages are realized by admixing with an acrylate ester latex binder an antioxidant and a chelating agent. Amount of the antioxidant is 0.1 to 3 weight parts whereas amount of the chelating agent is 0.2 to 3 weight parts, based on 100 weight parts of the latex polymer.

The latex of the Spaulding patent is prepared by polymerizing an acrylate ester, a carboxylic acid, an N-alkylol amide, and other conventional additives. Suitable antioxidant is selected from phenolics, especially hindered phenolic antioxidants, and phosphite esters. The chelating agent is selected from polycarboxylic acid/amine type of chelating or complexing agents which conform to the structural formula

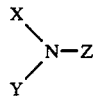

where X and Y are alkali metal carboxylate groups of the formula

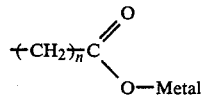

wherein n is a number from 1 to 6, or a carboxylic acid groups of the formula

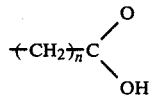

wherein n is a number from 1 to 6, or one but not both may be a hydroxyalkyl group of the formula $(—CH_2—)CH_2CH$ wherein n is a number from 1 to 6; and Z is an alkali metal carboxylate or carboxylic acid groups as defined for X and Y or a

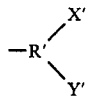

group wherein R′ is a methylene grouping of the formula

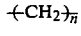

wherein n is a number from 1 to 12, a cyclohexane or benzene ring, and X′ and Y′ are alkali metal carboxylate, carboxylic acid or hydroxyalkyl groups as defined for X and Y, and one but not both may be an alkyl group containing from 1 to 20 carbon atoms or a grouping which conforms to the structure

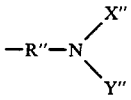

wherein R″, X″ and Y″ are defined as for R′, X and Y above; said phenolic antioxidant present in an amount from about 0.2 to 3 parts by weight based on 100 parts by weight of the acrylic polymer and said chelating agent present in an amount from about 0.2 to 3 parts by weight based on 100 parts by weight of the acrylic polymer.

Examples of the chelating agents fitting the above description are: ethylenediamine tetraacetic acid, the sodium salt of ethylenediamine tetraacetic acid, nitrilotriacetic acid, sodium salt of cyclohexanediamine tetraacetic acid, pentasodium diethylenetriamine pentaacetate, trisodium hydroxyethyl ethylenediamine triacetate. Other chelating agents such as sodium hexahydroxy heptannoate, sodium gluconate, citric acid, dihydroxy ethyl glycine may also be employed if desired.

At bottom of column 2 of the Spaulding patent, it is stated that it is known to add antioxidants to acrylate polymers. When this is done and such acrylate polymers are used alone, as in a cast film or a molded article, the antioxidants appear to effectively retard degradation. However, when such acrylate polymers are used as binders in nonwovens, only partial protection is achieved. Also, the addition of chelating agents to acrylate polymers without antioxidants, does not result in the polymer protection against degradation. It is only when the antioxidants are used in combination with the chelating agents in acrylate polymer latexes, that improved resistance to aging and to typical dry cleaning solvents is realized.

SUMMARY OF THE INVENTION

This invention relates to nonwoven fabrics bonded with saturated latexes comprising 65 to 85 weight parts of a soft hydrophobic acrylate monomer, 10 to 30 weight parts of a hard hydrophobic monomer, 0.1 to 5 weight parts of an unsaturated carboxylic acid, and 0.1 to 5 parts of an N-alkylol acrylamide or methacrylamide, said latex having admixed thereto 0.01 to 5 weight parts of an odor inhibition agent selected from amine-type antioxidants, and hindered or partially hindered phenols.

DETAILED DESCRIPTION OF THE INVENTION

This invention is based on a saturated latex that is used as a binder in making nonwoven fabrics that are used in medical/surgical applications. This latex, when used as a binder for making nonwoven fabrics, provides a balance of softness, physical strength, hydrophobicity, adhesion, low skin toxicity, and minimal odor after sterilization. All of these properties are requisites for a fabric that is used in medical/surgical applications.

The acrylic latex of this invention is prepared by free radical polymerization of 65 to 85 weight parts soft hydrophobic acrylate monomer, 10 to 30 weight parts of hard hydrophobic monomer, 0.1 to 5 weight parts of an unsaturated carboxylic acid, and 0.1 to 5 weight parts of an N-alkylol acrylamide or methacrylamide. Polymerization is carried out in the presence of 0.1 to 2 weight parts of a suitable free radical initiator and usually with less than one weight part of an emulsifier. To this latex is admixed about 0.01 to 5 weight parts of an odor inhibition agent selected from hindered or partially hindered phenols and amine-type antioxidants. The odor inhibition agents, as defined herein, also include free radical terminators or shortstops. In a preferred embodiment, free radical polymerization is carried out in the presence of 0.3 to 1 part of a free radical initiator and 0.1 to 0.5 part of an emulsifier with the monomers to be polymerized including 70 to 80 parts of a soft hydrophobic monomer, 15 to 25 parts of a hard hydrophobic monomer, 0.5 to 4 parts of unsaturated carboxylic acid, and 0.5 to 4 parts of N-alkylol acrylamide or methacrylamide. Amount of the odor inhibition agent in the preferred embodiment is in the range of 0.1 to 1 part, based on the weight of latex solids.

Typical polymerizations for the preparation of the latexes described herein are conducted by charging the reactor with appropriate amount of water, emulsifier and a portion of the initiator sufficient to initiate polymerization. The reactor is then evacuated, heated to the initiation temperature of about 80° C. and charged with a portion of the monomer premix which has been previously prepared by mixing water, emulsifier, the monomers, and polymerization modifiers, if any are employed. After the initial monomer charge has been allowed to react for a period of time, the proportioning of the remaining monomer premix is begun, the rate of proportioning being varied depending on the polymerization temperature, the particular initiator employed, and the amount of the monomer(s) being polymerized. After all the monomer premix has been charged, the final addition of initiator is made and the reactor and the latex heated with agitation for a length of time necessary to achieve the desired conversion. The pH of the latex is generally in the range of about 2 to 7.

In the latex, the particle size may be in the range of about 3000 angstroms. A generally satisfactory particle size may be, however, from about 500 to about 5000 angstroms. The total solids of the latexes may be varied up to about 70% and may relate to the fluidity wanted in the composition. Generally, it is desired to use a latex containing 45 to 55% solids.

Suitable soft hydrophobic monomers that can be used to prepare the latex of this invention include those monomers homopolymers of which have Tg falling within the range of about −80° C. to −20° C., preferably −60° to −30° C. Specific examples of such monomers include n-butyl acrylate, 2-ethylhexyl acrylate, and isobutyl acrylate. Preferred soft hydrophobic monomers are acrylic monomers that include n-butyl acrylate and isobutyl acrylate. Since ethyl acrylate forms a hydrophilic polymer, it is excluded from the class of monomers defined herein.

For purposes of this invention, suitable hard hydrophobic monomers are those that form homopolymers having Tg in the range of about +40° C. to +120° C., preferably +80° to +110° C. Specific examples of such hard hydrophobic monomers include styrene, 1-methyl styrene, methyl methacrylate, butyl methacrylate, and 2-ethylhexyl methacrylate. Preferred monomers in this class include styrene and methyl methacrylate.

A small amount of an acid is used in conjunction with N-alkylol acrylamide to facilitate curing at a lower temperature. Suitable acids for this purpose include monounsaturated, diunsaturated, monocarboxylic and dicarboxylic acids generally containing at least 3 carbon atoms and up to about 12 carbon atoms, preferably 3 to 6 carbon atoms. Such acids include acrylic, methacrylic, itaconic, fumaric, and maleic. Preferred acids are acrylic, methacrylic, and itaconic.

A small amount of N-alkylol acrylamide is also included in the polymerization formulation as a cross-linking agent. Such amides are derivatives of acrylic and methacrylic acids that contain 1 to 10, preferably 1 to 4 carbon atoms in the alkyl group. This class of amides includes N-methylol acrylamide, N-methylol methacrylamide, n and iso-butoxy methyl acrylamide. Preferred example of such amides is N-methylol acrylamide.

The usual types of surfactants that can be used herein include anionic and nonionic emulsifiers. Suitable anionic emulsifiers include alkali metal or ammonium salts of the sulfates of alcohols containing 8 to 18 carbon atoms such as sodium lauryl sulfate, alkali metal and ammonium salts of sulfonated petroleum and paraffin oils, sodium salts of sulfonic acids, alkylaryl sulfonates, alkali metal and ammonium salts of sulfonated dicarboxylic acid esters, and the like. Nonionic emulsifiers, such as octyl or nonylphenyl polyethyoxyethanol, can also be used. Latices of excellent stability can be prepared with emulsifiers selected from alkali metal and ammonium salts of aromatic sulfonic acids, alkylaryl sulfonates, long chain alkyl sulfonates, and poly(oxyalkylene) sulfonates.

Commonly used free radical initiators include the various peroxygen compounds such as persulfates, benzoyl peroxide, t-butyl hydroperoxide, and cumene hydroperoxide; and azo compounds such as azodiisobutyronitrile and dimethylazodiisobutyrate. Particularly useful initiators are the water-soluble peroxygen compounds such as hydrogen peroxide and the sodium, potassium and ammonium persulfates used by themselves or in an activated redox system. Typical redox systems include alkali metal persulfates in combination with a reducing substance such as polyhydroxyphenols and oxidizable sulfur compounds, a reducing sugar, dimethylaminopropionitrile, a diazomercaptan compound, and a water-soluble ferrous sulfate compound. Polymer latices with excellent stability can be obtained using alkali metal and ammonium persulfate initiators. The amount of initiator used will generally be in the range of 0.1 to 3% by weight, based on the weight of the monomers, preferably between 0.2 to 1%. The initiator can be charged at the outset of the polymerization, however, incremental addition of the initiator throughout polymerization can also be employed.

The latexes described herein can be compounded with, or have mixed herein, other known ingredients before impregnation and before curing. Such ingredients include curing agents, fillers, water repellent materials, plasticizers, antioxidants or stabilizers, antifoaming agents, dying adjuvants, pigments, and other compounding aids. Furthermore, thickeners or bodying agents may be added to the polymer latices so as to control the viscosity of the latexes and thereby achieve the proper flow properties for the particular application desired.

The odor inhibition agent can be added during polymerization of the latex or to the latex any time before the latex is used to form a nonwoven fabric or it can be added with other compounding ingredients either by itself or together with the compounding ingredients. Following addition of the odor inhibition agent, the latex is cured on the nonwoven fabric. The odor inhibition agent is selected from fully hindered and partially hindered phenols and amine-type antioxidants. The phenols can be partially or fully hindered, meaning that one or both of the ortho positions to the hydroxyl group on the benzene ring are substituted, preferably with tertiary alkyl groups of 4 to 6 carbon atoms each. As defined above, the hindered phenolic antioxidants also include free radical terminators or shortstops, especially the oil-soluble shortstops, such as di-t-amyl hydroquinone. However, shortstops are not considered to be hindered phenols or antioxidants in the conventional chemical parlance. The amine-type of antioxidants include ketone-amine condensation products, diaryldiamines, diarylamines, and ketone-diarylamine condensation products.

Within the class of partially and fully hindered phenols is the group of hindered phenolic antioxidants that can function as odor inhibition agents in the manner described herein. Examples of suitable hindered phenolic antioxidants that can be admixed with an acrylic latex in order to reduce odor upon sterilization with irradiation or steam, include the following:

(1) Phenolic compounds having the general formula $$Q-(CH_2)_w-A$$

wherein

Q is

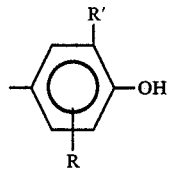

A is $$-CR(COOR'')_2\ COOR''\quad -C-(CH_2)_wQ\ COOR''$$

R is hydrogen or lower alkyl, R' is lower alkyl, R'' is alkyl group having from 6–24 carbon atoms, W is an integer from 1 to 4. Illustrative examples of the compounds shown above are

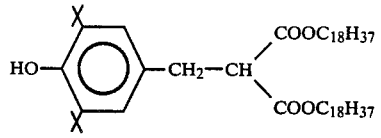

di-n-octadecyl(3,5-di-t-butyl-4-hydroxy-5-methylbenzyl) malonate and di-n-octadecyl (3,5-di-t-butyl-4-hydroxy-5-methylbenzyl) malonate.

(2) Phenolic compounds having the general formula

Q—R illustrative examples of which are 2,6-di-t-butylphenol, 2,4,6-tri-t-butylphenol, 2,6-dimethylphenol, and 2-methyl-4,6-di-t-butylphenol.

(3) Phenolic compounds having the formula $Q—C_wH_{2w}—Q$ illustrative examples of which are 2,2'-methylene-bis(6-t-butyl-4-methylphenol), and 4,4'-butylidene-bis(2,6-di-t-butylphenol).

(4) Phenolic compounds having the formula

R—O—Q illustrative examples of which are 2,5-di-t-butylhydroquinone and 2,6-di-t-butyl-4-hydroxyanisole.

(5) Phenolic compounds having the formula

Q—S—Q illustrative examples of which are 4,4'-thiobis-(2-t-butyl-5-methylphenol) and 2,2'-thiobis-(6-t-butyl-4-methylphenol).

(6) Phenolic compounds having the formula $Q—(CH_2)_w—S—(CH_2)_w—\overset{O}{\overset{\|}{C}}—OR''$ illustrative example of which is octadecyl-(3,5-dimethyl-4-hydroxybenzylthio)-acetate.

(7) Phenolic compounds having the formula

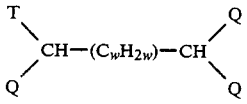

wherein T is hydrogen, R or q as defined above, illustrative examples of which are 1,1,3-tris(3,5-dimethyl-4-hydroxyphenyl)-propane and 1,1,5,5-tetrakis-(3-t-butyl-4-hydroxy-6-methylphenyl)-n-pentane.

(8) Phenolic compounds having the formula

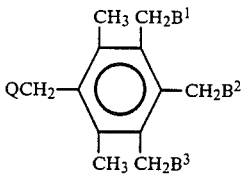

wherein $B^1$, $B^2$, and $B^3$ are hydrogen, methyl or Q, provided that when $B^1$ and $B^3$ are Q then $B^2$ is hydrogen or methyl and when $B^3$ is Q then $B^1$ and $B^2$ are hydrogen or methyl.

Illustrative example of such compound is 1,4-di(3,5-di-t-butyl-4-hydroxybenzyl)-2,3,5,6-tetramethylbenzene.

(9) Phenolic compounds having the formula

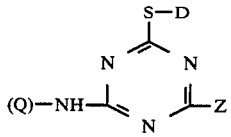

wherein Z is NHQ,—S—D or —O—Q; is alkyl group D having from 6–12 carbon atoms or $—C_wH_{2w})—S—R''$. Illustrative example of such compounds is 2,4-bis-(n-octylthio)-6-(3,5-di-t-butyl-4-hydroxyaniline)-1,3,5-triazine.

(10) Phenolic compounds having the formula

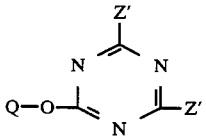

wherein Z' is —O—Q, —S—D or $—S—(C_wH_{2w})—SD$. Illustrative example of such compounds is 2,3-bis-(3,5-di-t-butyl-4-hydroxyphenoxy)-6-(n-octylthio)-1,3,5-triazine.

(11) Phenolic compounds having the formula $Q—C_zH_{2z}—COO—C_zH_{2z\,p}—R'''—(R)_{4-p}$ wherein p is an integer from 2 to 4 and R''' is a tetravalent radical selected from aliphatic hydrocarbons having from 1 to 30 carbon atoms, aliphatic mono and dithioethers having from 1 to 30 carbon atoms, and aliphatic mono and diethers having from 1 to 30 carbon atoms. Illustrative example of such compounds is 1,2-propylene glycol bis-[3-(3,5-di-t-butyl-4-hydroxyphenyl)propionate].

(12) Phenolic compounds having the formula

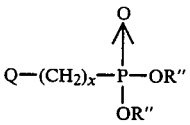

Illustrative examples of such compounds are dioctadecyl 3,5-di-t-butyl-4-hydroxybenzylphosphonate and di-n-octadecyl 1-(3,5-di-t-butyl-4-hydroxy-phenyl)-ethanephosphonate.

Preferred hindered phenolic antioxidants include trifunctional hindered phenols based alkylated benzenes, isocyanuric acid, and on hydrocinnamic acid. Preferred hindered phenolic antioxidants also include the alkylated hydroquinones and phenols having the following general structures A, B, C and D:

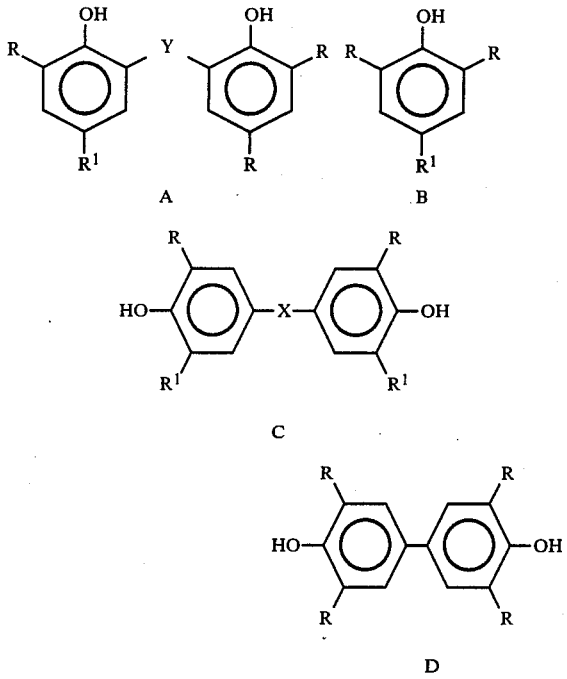

where R groups are individually selected from hydrogen and alkyl groups of 1 to 12 carbon atoms with at least one R group being selected from the alkyl groups; $R^1$ groups are individually selected from lower alkyl groups and hydroxyl groups; X is selected from lower alkylene groups and sulfur; and Y is selected from lower alkylene groups and sulfur. More preferably, the R groups are individually selected from hydrogen and alkyl groups of 3 to 12 carbon atoms, especially tertiary alkyl groups of 4 to 8 carbon atoms such as t-amyl and t-butyl, with at least one of the R groups being selected from the alkyl groups; the $R^1$ groups are selected from hydroxyl and alkyl groups of 1 to 3 carbon atoms; X is either methylene or sulfur; and Y is either methylene or sulfur.

Specific examples of the preferred hindered phenolic antioxidants include 2,2'-methylene-bis(4-ethyl-6-t-butylphenol) sold as AO425, 2,2'-methylene-bis(4-methyl-6-nonylphenol) sold as Naugawhite, 2,2'-methylene-bis(4-t-butyl-6-t-butylphenol) sold as Isonox 128, 2,2-methylene-bis(4-methyl-6-t-butylphenol) sold as AO 2246, 2,2'-thio-bis(4-methyl-6-t-butylphenol) sold as CAO-6, 4,4'-thio-bis(3-methyl-6-t-butylphenol) sold as Santowhite Crystals, butylated reaction product of p-cresol and dicyclopentadiene that is sold under the trade name of Wingstay L , 1,3,5-trimethyl-2,4,6-tris (3,5-t-butyl-4-hydroxybenzyl) benzene sold as AO330, di-ti-amyl hydroquinone, 3,5-di-t-butyl-4-hydroxyhydrocinnamic acid triester with 1,3,5-tris (2-hydroxyethyl)-s-triazine-2,4-6-(1H, 3H, 5H) trione that is available as Agerite SKT and Goodrite 3125, and 2,6-di-t-butyl-4-methylphenol, known as BHT. Also preferred in this group is the reaction product of 4,4-isopropylidene-di-phenol, isobutylene, and styrene which includes 2,2'-di-t-butyl bisphenol A, 2-t-butyl-2'-α-methylbenzyl bisphenol A, 2,6-di-t-butylphenol, and 2-t-butyl-4-isopropylphenol. This type of antioxidant is available under the trade name Superlite antioxidant.

Examples of suitable amine-type antioxidants include ketone-amine condensation products such as the polymeric dihydrotrimethylquinoline and 6-ethoxy-1,2-dihydro-2,2,4-tri-methylquinoline; diaryldiamines such as N,N'-diphenyl-p-phenylenediamine and N,N'-di-β-naphthyl-p-phenylenediamine; diarylamines include alkylated diphenylamines such as monooctyl diphenylamine and dioctyl diphenylamine; and ketone-diarylamine condensation products that include complex mixtures obtained by the reaction of diphenylamine and acetone.

The preferred amine-type of antioxidants suitable for purposes herein are the diaryldiamines, especially N,N'-di-β-naphthyl-p-phenylenediamine.

After admixing the odor inhibiting agent to the acrylic latex, the latex is compounded with fluorocarbons, cationic additives, and other additives to prevent static build-up and achieve other results. The finished latex is then applied to the web or mat of fibers in any suitable fashion such as by spraying, dipping, roll-transfer, or the like. Application of the latex to the fibers is preferably made at room temperature to facilitate cleaning of the associated apparatus. The solids concentration of the latex can be in the range of 5% to 60% by weight, and preferably from 5% to 35% when applied by dipping. When applied by roll-transfer, solids concentration of the latex is generally about 50% whereas with the spraying technique, it an range widely.

The proportion of the latex polymer that is applied to the web or mat is such as to provide 10 to 100%, preferably 25% to 40% by weight of the polymer, based on the total weight of the polymer and fibers. After application of the latex to the fibrous web, the impregnated or saturated web is dried either at room temperature or at elevated temperature. The web is subjected, either after completion of the drying or as the final step of the drying stage itself, to a baking or curing operation which may be effected at a temperature of about 210° to about 500° F. for a period which may range from about one-half hour at the lower temperatures to as low as one-half second at the upper temperatures. The cured and impregnated web is then allowed to cool. The conditions of drying and curing are controlled so that no appreciable deterioration or degradation of the fibers or polymer occurs. Preferably, the curing is effected at a temperature of 240° to 350° F. for a period under 3 minutes.

The fibers that are bonded with the latices described herein are formed into nonwoven mats or webs in which they are ordered or are randomly distributed. The fibers may comprise natural textile fibers such as jute, sisal, ramie, hemp and cotton, as well as many of the artificial organic textile fibers including rayon, those of cellulose esters such as cellulose acetate, vinyl resin fibers such as those of polyvinyl chloride and copolymers thereof, polyacrylonitrile and copolymers thereof, polymers and copolymers of olefins such as ethylene and propylene, condensation polymers such as polyimides or nylon types, polyesters, and the like. The fibers used can be those of a single composition or mixtures of fibers in a given web.

The preferred fibers for purposes herein are hydrophilic, especially cellulosic fibers, and blends of hydrophobic and hydrophilic fibers. Examples of hydrophobic fibers include polyester, polypropylene, and nylon fibers.

The acrylic latexes described herein, together with an odor inhibition agent admixed therein, can be further compounded with fluorocarbons, cationic additives, and other additives, in order to reduce static build-up, to obtain repellency, and achieve other results. The finished latex is then used to bond fibers which are subsequently formed into a nonwoven fabric, which, in turn, is used to make products that are used in the medical/surgical applications. Examples of such products, as already disclosed, include surgical caps, gowns, drapes, and wraps for surgical instruments. Since surgical uses require sterilized fabric, such products are wrapped in a plastic bag and sterilized, as by gamma ray irradiation. The plastic bag can be any suitable plastic including polyolefins, polyesters, polyvinyl chloride, and the like. The instrument wrap is used to wrap surgical instruments and then is sterilized, as with steam.

Sterilization by irradiation is generally accomplished using cobalt 60 at about 2.5 mega rads. Sterilization with steam is accomplished by the following schedule:

(a) 5 minutes to heat up to 275° F.,
(b) 5 minutes at 275° F., and
(c) 5 minutes to cool before opening autoclave.

As was already mentioned, nonwoven fabrics bonded with acrylic latexes and subjected to sterilization conditions noted above produced foul odors that have been described as acidic and irritating to eyes and nose. A sample of finished acrylic latex, prepared in absence of an odor inhibition agent and used as a bonding agent for making a nonwoven fabric composed mostly of cellulosic fibers and a smaller amount of polyester fibers, gave an odor panel rating of 3.2 on sterilization of the fabric. This acrylic latex was prepared by polymerizing certain monomers in the presence of about 0.5 weight part sodium persulfate initiator and about 0.5 weight part of sodium lauryl sulfate emulsifier. The latex was prepared by polymerizing the following monomers, in the indicated amounts, at about 80° C.:

(a) n-butyl acrylate: 75 wt. parts
(b) styrene: 20 wt. parts
(c) glacial acrylic acid: 3 wt. parts
(d) N-methylol acrylamide: 2 wt. parts The polymerization procedure utilized consisted of the initial preparation in a premix pot of a premix of the monomers, some water and some emulsifier. Remainder of water and emulsifier were added to a reactor which was then heated to the polymerization temperature of about 80° C. While heating to the polymerization temperature, a portion of the initiator was added to the reactor. After reaching the desired temperature, the premix was added at a controlled rate. Once all of the premix was added to the reactor, remainder of the initiator was also added to the reactor and the reaction was maintained for about two hours under constant agitation. When the desired conversion of 99%+ was reached, the latex was cooled and stripped. The resulting latex had 47.5% solids.

Different samples of the acrylic latex described above were prepared by admixing antioxidants and then further compounding the latexes with fluorocarbons, cationic agents, and other materials, before using the finished latexes to form nonwoven fabrics from which surgical products were made. The surgical products were packed in a plastic bag and sterilized by gamma ray irradiation. Procedure used in preparing latex, nonwoven fabric, and sterilization was identical in each case except for inclusion of different odor inhibition agents in the latex samples.

The odor rating was obtained by opening a pack of nonwoven fabric that was sterilized with gamma radiation. The pack was opened in a closed room measuring about 10′ by 10′. Each pack contained 20 square yards of a nonwoven fabric, all of which was spread out in the room. After the fabric laid spread out in the room for 5 minutes, a panel of 10 persons entered the room and rated the odor intensity on a scale of 1 to 5, defined as follows:

1=neutral
2=slightly offensive
3=mildly offensive
4=moderately offensive
5=extremely offensive A number of odor inhibition agents were evaluated in this manner, results of which are tabulated in Table I below, which indicate the level of agent on dry basis, admixed with the acrylic latex, and the resulting averaged odor rating:

TABLE I

| Additive | Amount | Odor Rating |
|---|---|---|
| None | 0 | 3.2 |
| Wingstay 29 | 0.5 phr | 2.7 |
| Wingstay L | 0.5 phr | 2.1 |
| Antioxidant SP | 0.5 phr | 2.9 |
| Naugawhite | 0.5 phr | 2.5 |
| Agerite White | 0.5 phr | 2.5 |
| BHT | 0.5 phr | 2.5 |
| Santowhite Crystals | 0.5 phr | 2.4 |
| AO 425 | 0.5 phr | 2.4 |
| Superlite | 0.5 phr | 2.4 |
| Agerite SKT | 0.5 phr | 2.7 |
| Goodrite 3125 | 0.5 phr | 2.4 |
| A0330 | 0.5 phr | 2.7 |
| DTAHQ | 0.5 phr | 2.5 |

Wingstay 29 is a p-oriented styrenated diphenylamine, Wingstay L is a butylated reaction product of p-cresol and dicyclopentadiene, Antioxidant SP stabilizer is a styrenated phenol containing 1 to 3 styrene groups attached to the benzene ring, Naugawhite is 2,2′-methylene-bis(4-methyl-6-t-butylphenol), Agerite White is N,N′-dinaphthyl-p-phenylene diamine, BHT is 2,6-di-t-butyl-4-methyl-phenol, Santowhite Crystals is 4,4′-thiobis(3-methyl-6-t-butylphenol), AO 425 is 2,2′-methylene-bis(4-ethyl-6-t-butylphenol), and Superlite is a reaction product of bisphenol A, isobutylene, and styrene reacted at about 70° C. under 0–10 psig of pressure for a period of about 4½ hours in presence of a clay catalyst.

Additionally, AO330 is 1,3,5-trimethyl-2,4,6-tris (3,5-t-butyl-4-hydroxybenzyl) benzene, DTAHQ is di-t-amyl hydroquinone, and both Agerite SKT and Goodrite 3125 are 3,5-di-t-butyl-4-hydroxyhydrocinnamic acid triester with 1,3,5-tris (2-hydroxyethyl)-s-triazine-2,4,6-(1H,3H,5H)trione.

When styrene was replaced with the same weight of methyl methacrylate in the preparation of the latex sample with 0.5 phr of Superlite stabilizer, otherwise prepared and tested identically as described above, the fabric gave an odor rating of 2.0.

The data presented in Table I has a statistical deviation of ±0.5 unit for any single determination, however, the above data represents averages of many determinations.

The latexes described herein are adapted for use as binders for fibers which are made into nonwoven fabrics. These fabrics have applications in the medical/surgical field which require repellancy to body fluids such as blood, urine, and perspiration. The repellency is measured in terms of repellency to alcohol and saline solution. Due to the particular applications wherein the nonwoven fabric comes in contact with human body, the latexes of this invention require properties such as softness, physical strength, hydrophobicity, low skin toxicity, adhesion during forming of the nonwoven fabric, and of course, minimal odor after sterilization.

To obtain a hydrophobic latex that will have the repellency property, it is necessary to select hydrophobic monomers and to have a low content of anionic emulsifier since it is known that hydrophobicity of the latex can be increased by reducing the level of emulsifier. Also, hydrophobicity of the latex can be enhanced by compounding the latex with materials such as fluorocarbons. An anionic emulsifier level of 3 phr, per 100 parts of dry latex, is normally considered high whereas less than 1.0 phr is normally considered to be low. A high content of anionic emulsifier in a latex recipe will not result in a repellent latex, however, the desired repellency may result if the latex is compounded with materials such as fluorocarbons. A higher level of nonionic emulsifier of up to about 5 phr can be used, relative to anionic emulsifier, to maintain repellency. The use of an unsaturated acid in conjunction with a N-alkylol acrylamide allows the curing to proceed more efficiently and at a lower temperature. However, in the past, an acid-containing latex made on a commercial scale had to contain in excess of 1.0 phr emulsifier to remain stable and whenever amount of emulsifer was less than 1.0 phr, the resulting latex was unstable, meaning that it contained floc, i.e., agglomerated particles.

Selection of specific soft and hard hydrophobic monomers, as described herein, allows the preparation of a soft, repellent latex by the use of a low level of an emulsifier. This is the first time that it was possible to produce a hydrophobic polymer in a low-emulsifer recipe and this is also the first time that it was possible to successfully combine carboxyl and N-alkylol acrylamide chemistry in a low-emulsifier recipe to produce a stable, soft, and repellent latex. Previous work appeared to require the functionality of acrylamide and N-alkylol acrylamide.

We claim:

1. Sterilized nonwoven fabric that has a reduced odor on sterilization comprising nonwoven fibers bonded with a saturated latex prepared by free radical initiation comprising a preponderance of a soft hydrophobic monomer having Tg in the range of about −80° C. to −20° C., a lesser amount of a hard hydrophobic monomer having Tg in the range of about +40° C. to +120° C., a small amount of an unsaturated carboxylic acid, a small amount of N-alkylol acrylamide or methacrylamide, and a sufficient amount of an emulsifier, said latex having admixed therein about 0.01 to 5 weight parts per 100 weight parts of latex solids of an odor inhibition agent selected from amine-type antioxidants and hindered phenols that have the function of reducing the odor that is generated on sterilization of the nonwoven fabric.

2. Nonwoven fabric of claim 1 that is repellent to body fluids wherein said latex is prepared by polymerizing 65 to 85 weight parts of a soft acrylate monomer, 10 to 30 weight parts of a hard monomer, 0.1 to 5 weight parts of an unsaturated carboxylic acid containing 3 to 12 carbon atoms, and 0.1 to 5 weight parts of N-alkylol acrylamide or methacrylamide containing 1 to 10 carbon atoms in the alkyl group.

3. Nonwoven fabric of claim 2 wherein said odor inhibition agent is a hindered phenol selected from alkylated hydroquinones and phenols.

4. Nonwoven fabric of claim 3 wherein said odor inhibition agent is selected from the following structures A, B, C and D:

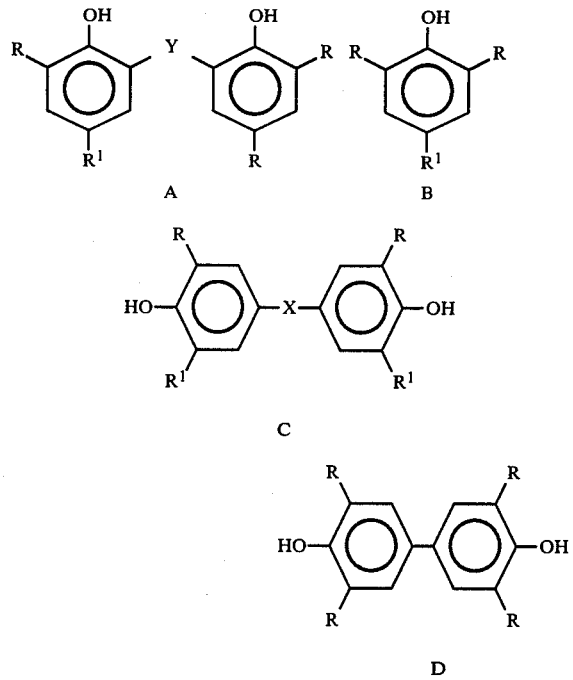

where R groups are individually selected from hydrogen and alkyl groups of 1 to 12 carbon atoms, with at least one R group being selected from the alkyl groups; $R^1$ groups are individually selected from hydroxyl and lower alkyl groups; and X and Y are selected from lower alkylene groups and sulfur.

5. Nonwoven fabric of claim 4 wherein in said odor inhibition agent R groups are individually selected from hydrogen and alkyl groups of 3 to 12 carbon atoms, with at least one R group being selected from the alkyl groups; the $R^1$ groups are individually selected from hydroxyl and alkyl groups of 1 to 3 carbon atoms; and X and Y are selected from methylene and sulfur.

6. Nonwoven fabric of claim 3 wherein said odor inhibition agent selected from 2,2'-methylene-bis(4-ethyl- 6-t-butylphenol); 2,2'-methylene-bis(4-methyl-6-nonylphenol); 2,2'-methylene-bis(4-t-butyl-6-t-butylphenol); 2,2-methylene-bis(4-methyl-6-t-butylphenol); butylated reaction product of p-cresol and dicyclopentadiene, 2,6-di-t-butyl-4-methylphenol; reaction product of 4,4-isopropylidene-diphenol, isobutylene, and styrene; 2,2'-thio-bis(4-methyl-6-t-butylphenol); 4,4'-thio-bis(3-methyl-6-t-butylphenol); 1,3,5-trimethyl-2,4,6-tris(3,5-t-butyl-4-hydroxybenzyl)benzene; di-t-amyl hydroquinone; and 3,5-di-t-butyl-4-hydroxyhydrocinnamic acid triester with 1,3,5-tris(2-hydroxyethyl)-s-triazine-2,4,6-(1H,3H,5H) trione.

7. Nonwoven fabric of claim 6 wherein said latex is prepared by polymerizing, in presence of 0.1 to 2 weight parts of an initiator and less than 1.0 weight part of anionic emulsifier, 70 to 80 weight parts of said soft monomer homopolymer of which has Tg in the range of −60° C. to −30° C., 15 to 25 weight parts of said hard monomer homopolymer of which has Tg in the range of +80° C. to +110° C., 0.5 to 4 weight parts of said unsaturated carboxylic acid containing 3 to 6 carbon atoms, and 0.5 to 4 weight parts of said N-alkylol acrylamide or methacrylamide containing 1 to 4 carbon atoms in said alkyl group, said odor inhibition agent is admixed with said latex at a level of 0.1 to 1 weight part per 100 weight parts of latex solids.

8. Nonwoven fabric of claim 7 made from fibers selected from natural, synthetic, and mixtures of such fibers, and sterilized by irradiation or steam wherein said soft monomer is selected from n-butyl acrylate, 2-ethylhexyl acrylate, and isobutyl acrylate; said hard monomer is selected from styrene, 1-methyl styrene, methyl methacrylate; said N-alkylol acrylamide or methacrylamide is selected from N-methylol acrylamide and methacrylamide, N-butylol acrylamide and methacrylamide, and n- and iso-butoxy methyl acrylamide; and said unsaturated acid is selected from acrylic acid, methacrylic acid, itaconic acid, fumaric acid, and maleic acid.

9. Nonwoven fabric of claim 2 wherein said odor inhibition agent is an amine-type of antioxidant selected from ketone-amine condensation products, diarylamines, diaryldiamines, and ketone-diarylamine condensation products.

10. Nonwoven fabric of claim 2 wherein said odor inhibition agent is selected from polymeric dihydrotrimethylquinoline; 6-ethoxy-1,2-dihydro-2,2,4-trimethylquinoline; N,N'-diphenyl-p-phenylene-diamine; N,N'-di-$\beta$-naphthyl-p-phenylenediamine; alkylated diphenylamines; and reaction products of diphenylamine and acetone.

11. Nonwoven fabric of claim 10 made from at least a preponderance of cellulose fibers and sterilized by irradiation or steam wherein said latex is prepared by polymerizing, in presence of 0.1 to 2 weight parts of an initiator and and less than 1.0 weight part of anionic emulsifier, 70 to 80 weight parts of said soft monomer, 15 to 25 weight parts of said hard monomer, 0.5 to 4 weight parts of said unsaturated carboxylic acid containing 3 to 6 carbon atoms, and 0.5 to 4 weight parts of said N-alkylol acrylamide or methacrylamide containing 1 to 4 carbon atoms in said alkyl group, said odor inhibition agent is admixed with said latex at a level of 0.1 to 1 weight part per 100 weight parts of latex solids.

12. Nonwoven fabric of claim 11 wherein said soft monomer is selected from n-butyl acrylate, 2-ethylhexyl acrylate and isobutyl acrylate; said hard monomer is selected from styrene, 1-methyl styrene, methyl methacrylate; said N-alkylol acrylamide or methacrylamide is selected from N-methylol acrylamide and methacrylamide, N-butylol acrylamide and methacrylamide, and n- and iso-butoxy methyl acrylamide; and said unsaturated acid is selected from acrylic acid, methacrylic acid, itaconic acid, fumaric acid, and maleic acid.

13. Method of making sterilized nonwoven fabric having reduced odor on sterilization comprising bonding nonwoven fibers with a saturated latex, forming a nonwoven fabric from the bonded fibers, and sterilizing said nonwoven fabric; said nonwoven fibers are bonded with a latex prepared by free radical initiation comprising a preponderance of a soft hydrophobic monomer having Tg in the range of about −80° C. to −20° C., a lesser amount of a hard hydrophobic monomer having Tg in the range of about +40° C. to +120° C., a sufficient amount of an unsaturated carboxylic acid, a small amount of N-alkylol acrylamide or methacrylamide and a small amount of an emulsifier, said latex having admixed therein about 0.01 to 5 weight parts per 100 weight parts of latex solids of an odor inhibition agent selected from hindered phenols and amine-type antioxidants that have the function of reducing the odor that is generated on sterilization of the nonwoven fabric.

14. Method of claim 13, wherein said fabric is repellent to body fluids and wherein said latex is prepared by polymerizing 65 to 85 weight parts of a soft acrylate monomer, 10 to 30 weight parts of a hard monomer, 0.1 to 5 weight parts of an unsaturated carboxylic acid containing 3 to 12 carbon atoms, and 0.1 to 5 weight parts of N-alkylol acrylamide or methacrylamide containing 1 to 10 carbon atoms in the alkyl group.

15. Method of claim 14 wherein said odor inhibition agent is a hindered phenol selected from alkylated hydroquinones and phenols.

16. Method of claim 15 wherein said odor inhibition agent is selected from the following structures A, B, C and D:

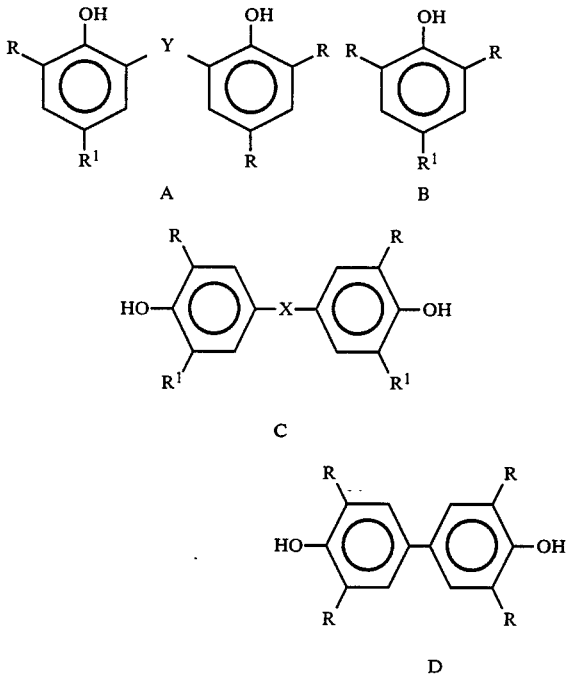

where R groups are individually selected from hydrogen and alkyl groups of 1 to 12 carbon atoms, with at least one R group being selected from the alkyl groups; $R^1$ groups are individually selected from hydroxyl and lower alkyl groups; and X and Y are selected from lower alkylene groups and sulfur.

17. Method of claim 16 wherein in said odor inhibition agent, R groups are individually selected from hydrogen and alkyl groups of 3 to 12 carbon atoms, with at least one R group being selected from the alkyl groups; the $R^1$ groups are individually selected from hydroxyl and alkyl groups of 1 to 3 carbon atoms; and X and Y are selected from methylene and sulfur; said method also including the step of curing said nonwoven fabric prior to said sterilizing step.

18. Method of claim 15 wherein said agent odor inhibition is selected from 2,2'-methylene-bis(4-ethyl-6-t-butylphenol); 2,2'-methylene-bis(4-methyl-6-nonylphenol); 2,2'-methylene-bis(4-t-butyl-6-t-butylphenol); 2,2-methylene-bis(4-methyl-6-t-butylphenol); butylated reaction product of p-cresol and dicyclopentadiene, 2,6-di-t-butyl-4-methylphenol; reaction product of 4,4-isopropylidene-diphenol, isobutylene, and styrene; 2,2'-thio-bis(4-methyl-6-t-butylphenol); 4,4'-thio-bis(3-methyl-6-t-butylphenol); 1,3,5-trimethyl-2,4,6-tris(3,5-t-butyl-4-hydroxybenzyl)benzene; di-t-amyl hydroquinone; and 3,5-di-t-butyl-4-hydroxyhydrocinnamic acid triester with 1,3,5-tris(2-hydroxyethyl)-s-triazine-2,4,6(1H,3H,5H)trione.

19. Method of claim 18 wherein said latex is prepared by polymerizing, in presence of 0.1 to 2 weight parts of an initiator and less than 1.0 weight part of anionic emulsifier, 70 to 80 weight parts of said soft monomer homopolymer of which has Tg in the range of −60° C. to −30° C., 15 to 25 weight parts of said hard monomer homopolymer of which has Tg in the range of +80° C. to +110° C., 0.5 to 4 weight parts of said unsaturated carboxylic acid containing 3 to 6 carbon atoms, and 0.5 to 4 weight parts of said N-alkylol acrylamide or methacrylamide containing 1 to 4 carbon atoms in said alkyl group, said odor inhibition agent is admixed with said latex at a level of 0.1 to 1 weight part per 100 weight parts of latex solids.

20. Method of claim 19 made from at least a preponderance of cellulose fibers and sterilized by irradiation or steam wherein said soft monomer is selected from n-butyl acrylate, 2-ethylhexyl acrylate, and isobutyl acrylate; said hard monomer is selected from styrene, α-methyl styrene, methyl methacrylate; said N-alkylol acrylamide or methacrylamide is selected from N-methylol acrylamide and methacrylamide, N-butylol acrylamide and methacrylamide, and n- and iso-butoxy methyl acrylamide; and said unsaturated acid is selected from acrylic acid, methacrylic acid, itaconic acid, fumaric acid, and maleic acid.

21. Method of claim 14 wherein said odor inhibition agent is an amine-type of antioxidant selected from ketone-amine condensation products, diarylamines, diaryldiamines, and ketone-diarylamine condensation products.

22. Method of claim 21 wherein said odor inhibition agent is selected from polymeric dihydrotrimethylquinoline; 6-ethoxy-1,2-dihydro-2,2,4-trimethylquinoline; N,N'-diphenyl-p-phenylene-diamine; N,N'-di-β-naphthyl-p-phenylenediamine; alkylated diphenylamines; and reaction products of diphenylamine and acetone.

23. Method of claim 22 made from at least a preponderance of cellulose fibers and sterilized by irradiation or steam wherein said latex is prepared by polymerizing, in presence of 0.1 to 2 weight parts of an initiator and less than 1.0 weight part of anionic emulsifier, 70 to 80 weight parts of said soft monomer homopolymer of which has Tg in the range of −60° C. to −30° C., 15 to 25 weight parts of said hard monomer homopolymer of which as Tg in the range of +80° C. to +110° C., 0.5 to 4 weight parts of said unsaturated carboxylic acid containing 3 to 6 carbon atoms, and 0.5 to 4 weight parts of said N-alkylol acrylamide or methacrylamide containing 1 to 4 carbon atoms in said alkyl group, said odor inhibition agent is admixed with said latex at a level of 0.1 to 1 weight part per 100 weight parts of latex solids.

24. Method of claim 23 wherein said soft monomer is selected from n-butyl acrylate and 2-ethylhexyl acrylate; said hard monomer is selected from styrene, α-methyl styrene, and methyl methacrylate; said N-alkylol acrylamide or methacrylamide is selected from N-methylol acrylamide and methacrylamide, N-butylol acrylamide and methacrylamide, and n- and iso-butoxy methyl acrylamide; and said unsaturated acid is selected from acrylic acid, methacrylic acid, itaconic acid, fumaric acid, and maleic acid; said method also including the step of curing said nonwoven fabric prior to said sterilizing step.

25. A saturated latex prepared by free radical initiation comprising a preponderance of a soft hydrophobic monomer having Tg in the range of about −80° C. to −20°, a lesser amount of a hard hydrophobic monomer having Tg in the range of about +40° C. to +120° C., a small amount of an unsaturated carboxylic acid, a small amount of N-alkylol acrylamide or methacrylamide, and a sufficient amount of an emulsifier, said latex having admixed therein about 0.01 to 5 weight parts per 100 weight parts of latex solids of an odor inhibition agent selected from amine-type antioxidants and hindered phenols that have the function of reducing the odor that is generated on sterilization of the nonwoven fabric bonded therewith.

26. Latex of claim 24 wherein said latex is prepared by polymerizing 65 to 85 weight parts of a soft acrylate monomer, 10 to 30 weight parts of a hard monomer, 0.1 to 5 weight parts of an unsaturated carboxylic acid containing 3 to 12 carbon atoms, and 0.1 to 5 weight parts of N-alkylol acrylamide or methacrylamide containing 1 to 10 carbon atoms in the alkyl group.

27. Latex of claim 26 wherein said odor inhibition agent is a hindered phenol selected from alkylated hydroquinones and phenols.

28. Latex of claim 27 wherein said odor inhibition agent is selected from the following structures A, B, C and D:

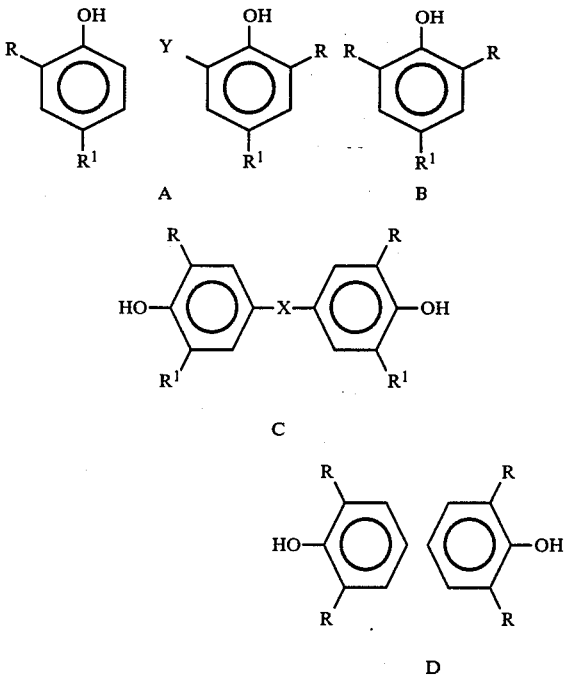

where R groups are individually selected from hydrogen and alkyl groups of 1 to 12 carbon atoms, with at least one R group being selected from the alkyl groups; $R^1$ groups are individually selected from hydroxyl and lower alkyl groups; and X and Y are selected from lower alkylene groups and sulfur.

29. Latex of claim 28 wherein in said odor inhibition agent R groups are individually selected from hydrogen and alkyl groups of 3 to 12 carbon atoms, with at least one R group being selected from the alkyl groups; the $R^1$ groups are individually selected from hydroxyl and alkyl groups of 1 to 3 carbon atoms; and X and Y are selected from methylene and sulfur.

30. Latex of claim 27 wherein said odor inhibition agent is selected from 2,2'-methylene-bis(4-ethyl- 6-t-butylphenol); 2,2'-methylene-bis(4-methyl-6-nonylphenol); 2,2'-methylene-bis(4-t-butyl-6-t-butylphenol); 2,2-methylene-bis(4-methyl-6-t-butylphenol); butylated reaction product of p-cresol and dicyclopentadiene, 2,6-di-t-butyl-4-methylphenol; reaction product of 4,4-isopropylidene-diphenol, isobutylene, and styrene; 2,2'-thio-bis(4-methyl-6-t-butylphenol); 4,4'-thio-bis(3-methyl-6-t-butylphenol); 1,3,5-trimethyl-2,4,6-tris(3,5-t-butyl-4-hydroxybenzyl)benzene; di-t-amyl hydroquinone; and 3,5-di-t-butyl-4-hydroxyhydrocinnamic acid triester with 1,3,5-tris(2-hydroxyethyl)-s-triazine-2,4,6-(1H,3H,5H) trione.

31. Latex of claim 30 wherein said latex is prepared by polymerizing, in presence of 0.1 to 2 weight parts of an initiator and less than 1.0 weight part of anionic emulsifier, 70 to 80 weight parts of said soft monomer homopolymer of which has Tg in the range of −60° C. to −30° C., 15 to 25 weight parts of said hard monomer homopolymer of which has Tg in the range of +80° C. to +110° C., 0.5 to 4 weight parts of said unsaturated carboxylic acid containing 3 to 6 carbon atoms, and 0.5 to 4 weight parts of said N-alkylol acrylamide or methacrylamide containing 1 to 4 carbon atoms in said alkyl group, 0.1 said odor inhibition agent is admixed with said latex at a level of 0.1 to 1 weight part per 100 weight parts of latex solids.

32. Latex of claim 31 wherein said soft monomer is selected from n-butyl acrylate, 2-ethylhexyl acrylate, and isobutyl acrylate; said hard monomer is selected from styrene, α-methyl styrene, methyl methacrylate; said N-alkylol acrylamide or methacrylamide is selected from N-methylol acrylamide and methacrylamide, N-butylol acrylamide and methacrylamide, and n- and iso-butoxy methyl acrylamide; and said unsaturated acid is selected from acrylic acid, methacrylic acid, itaconic acid, fumaric acid, and maleic acid.

33. Latex of claim 26 wherein said odor inhibition agent is an amine-type antioxidant selected from ketone-amine condensation products, diarylamines, diaryldiamines, and ketone-diarylamine condensation products.

34. Latex of claim 26 wherein said odor inhibition agent is selected from polymeric dihydrotrimethylquinoline; 6-ethoxy-1,2-dihydro-2,2,4-trimethylquinolone; N,N'-diphenyl-p-phenylene-diamine; N,N'-di-β-naphthyl-p-phenylenediamine; alkylated diphenyhlamines; and reaction products of diphenylamine and acetone.

35. Latex of claim 34 wherein said latex is prepared by polymerizing, in presence of 0.1 to 2 weight parts of an initiator and less than 1.0 weight part of anionic emulsifier, 70 to 80 weight parts of said soft monomer, 15 to 25 weight parts of said hard monomer, 0.5 to 4 weight parts of said unsaturated carboxylic acid containing 3 to 6 carbon atoms, and 0.5 to 4 weight parts of said N-alkylol acrylamide or methacrylamide containing 1 to 4 carbon atoms in said alkyl group, said odor inhibition agent is admixed with said latex at a level of 0.1 to 1 weight part per 100 weight parts of latex solids.

36. Latex of claim 35 wherein said soft monomer is selected from n-butyl acrylate, 2-ethylhexyl acrylate and isobutyl acrylate; said hard monomer is selected from styrene, α-methyl styrene, methyl methacrylate; said N-alkylol acrylamide or methacrylamide is selected from N-methylol acrylamide and methacrylamide, N-butylol acrylamide and methacrylamide, and n- and isobutoxy methyl acrylamide; and said unsaturated acid is selected from acrylic acid, methacrylic acid, itaconic acid, fumaric acid, and maleic acid.

* * * * *